US006123559A

United States Patent [19]

Murakami et al.

[11] Patent Number: 6,123,559

[45] Date of Patent: Sep. 26, 2000

[54] SMALLER MATING FORCE CONNECTOR ASSEMBLY

[75] Inventors: Takao Murakami; Masaru Fukuda, both of Shizuoka, Japan

[73] Assignee: Yazaki Corporation, Tokyo, Japan

[21] Appl. No.: 09/459,333

[22] Filed: Dec. 13, 1999

[30] Foreign Application Priority Data

Jan. 13, 1999 [JP] Japan ..... 11-006156

[51] Int. Cl.[7] ..... H01R 13/62

[52] U.S. Cl. ..... 439/157; 439/347; 439/489

[58] Field of Search ..... 439/157, 347, 439/310, 488, 489

[56] References Cited

FOREIGN PATENT DOCUMENTS 7-135046 5/1995 Japan .
7-220806 8/1995 Japan .

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

A smaller mating force connector assembly includes a first connector having a housing and a sliding frame formed with a cam groove, and a second connector having a boss movable along and within the cam groove. The first connector housing receives the sliding frame when the first connector mates with the second connector. The housing of the first connector has a first bracket and the sliding frame has a second bracket. Each bracket has a through hole for receiving a securing bolt the brackets overlap one another so that the through holes align with each other when the first connector housing receives completely the sliding frame. The bracket of the first connector is formed with a recess which fits with the second bracket of the sliding frame when the first connector housing receives completely the sliding frame. The sliding frame has a pair of side plates each formed with the cam groove and a front plate joined to each of the side plates by means of a compensating rib. The second bracket of the sliding frame is extending perpendicular to the front plate.

5 Claims, 3 Drawing Sheets

SMALLER MATING FORCE CONNECTOR ASSEMBLY

BACKGROUND OF THE INVENTION

1. Field of the Invention

This invention relates to a smaller mating force connector assembly having a sliding frame for reducing a mating force between plug and receptacle connectors, particularly to such a connector assembly having a mating force reducing sliding frame which is surely prevented from coming out of the housing of the connector assembly after the complete insertion of the sliding frame into the connector housing. Furthermore, the connector assembly is easily recognized of incomplete mating of the plug and receptacle connectors and is improved in handling of the sliding frame.

2. Prior Art

A conventional smaller mating force connector assembly having a sliding frame has been widely used to reduce a larger mating force between a pair of plug and receptacle connectors mounted with a large number of electrical terminals.

For example, Japanese Patent Application Laid-open No. H. 7-135046 has disclosed such a smaller mating force connector assembly shown in FIGS. 3A to 3C.

In FIG. 3A, a smaller mating force connector assembly 100 includes a receptacle connector 110, a plug connector 120 received in the plug connector 110, and a sliding frame 130 inserted into the receptacle connector 110 to couple the connectors together.

The plug connector 120 has four bosses 121 each extending perpendicularly from a side wall of the connector 120. Meanwhile, the sliding frame 130 is formed with four inclined cam grooves 131 each associated with one of the bosses.

As shown in FIG. 3B, the sliding frame 130 is preliminarily inserted halfway into the receptacle connector 110 so that the entrance of each cam groove 131 can align with the associated boss 121 of the plug connector 120.

Next, the sliding frame 130 is further moved into the receptacle connector 110, so that each boss 121 (see FIG. 3A) of the plug connector 120 moves along the associated cam groove 131 of the sliding frame 130 to further advance the plug connector 120 into the receptacle connector 110. Then, as shown in FIG. 3C, the receptacle connector 110 completely receives the sliding frame 130 so that the plug connector 120 completely mates with the receptacle connector 110.

Referring again to FIG. 3A, the sliding frame 130 has a pair of resilient lock arms 132 each of which is engageable with a cut-out portion of a wall of the receptacle connector 110 to prevent unintentional coming-out of the sliding frame 130 after the complete insertion thereof into the receptacle connector 110.

However, the aforementioned conventional smaller mating force connector 100 has the disadvantage that the resilient lock arms 132 do not provide an enough force to securely hold the sliding frame 130. For example, when the connector assembly 100 is applied in a vehicle, the sliding frame 130 which has been fully inserted into the receptacle connector 110 may come out of the receptacle connector due to an impactive force or vibration generated in the operating vehicle.

In addition, when the sliding frame 130 has been incompletely inserted into the receptacle connector 110, the plug connector 120 is not fully inserted into the receptacle connector 110. Thus, in the conventional connector assembly 100, a half mating state of the plug connector 120 is recognized by watching the extension condition of a front plate 130A of the sliding frame 130. However, a slight extension of the front wall 130A of the sliding frame 130 may be overlooked so that an incomplete engagement of the plug connector 120 will be disadvantageously unrecognized.

Moreover, the sliding frame 130 of the conventional connector assembly 100 is not readily held by hand when the sliding frame 130 is positioned near the fully inserted condition since the front plate 130A of the sliding frame 130 has a flat outside surface.

SUMMARY OF THE INVENTION

In view of the above-mentioned disadvantages of the conventional connector assembly, an object of the present invention is to provide a smaller mating force connector assembly having a sliding frame in which the sliding frame is surely prevented from coming out of a connector housing after the complete insertion of the sliding frame into the connector housing. The connector assembly can be easily recognized of an incompletely inserted condition of the sliding frame, and the sliding frame can be more readily handled by hand.

To achieve the object, a smaller mating force connector assembly of a first aspect of the invention includes a first connector having a housing and a sliding frame formed with a cam groove and a second connector having a boss movable along and within the cam groove. The sliding frame is inserted into the first connector housing so that the first connector mates with the second connector. The first connector housing has a first bracket and the sliding frame has a second bracket. Each bracket has a through hole for receiving a securing bolt. The brackets overlap one another such that the through holes align with each other when the first connector housing receives completely the sliding frame.

The such configured connector assembly enables the sliding frame which is securely held in the first connector housing by using a set bolt when the sliding frame has been fully inserted in the connector housing. Thereby, even when the connector assembly is applied in a vehicle, the sliding frame which has been fully inserted into the receptacle connector is prevented from coming of the first connector housing due to an impactive force or vibration generated in the operating vehicle.

In the meantime, when the first connector has incompletely received the sliding frame, that is, when the first and second connectors have incompletely mated with each other, the couple of bracket holes of the first connector and the sliding frame do not align with one another, so that the set bolt can not pass through the bracket holes. Thereby, the incomplete mating of the first and second connectors will be surely recognized.

In addition, a worker can hold the brackets by hand during the insertion of the sliding frame into the first connector housing, improving the insertion work of the sliding frame in workability.

Preferably, in the smaller mating force connector assembly having a second additional aspect of the invention, the bracket of the first connector housing is formed with a recess which fits just with the second bracket of the sliding frame when the first connector housing receives completely the sliding frame.

Thus, when the second bracket of the sliding frame has been received to be fit in the recess of the bracket of the first connector, the fully mated condition of the first and second connectors is surely recognized.

Since the second bracket of the sliding frame has been received to be fit in the recess of the bracket of the first connector, the appearance of the connector assembly in the fully mated condition is not degraded.

Preferably, in the smaller mating force connector assembly having a third additional aspect of the invention, the sliding frame has a pair of side plates each formed with the cam groove and a front plate which is joined to each of the side plates by means of a compensating rib. The second bracket of the sliding frame is extending perpendicular to the front plate.

The structure with the rib according to the third additional aspect of the invention enables to compensate the front plate and the second bracket of the sliding frame, which sufficiently resists against an operational force during the mating of the first and second connectors, enhancing the smooth mating of the first and second connectors.

DETAILED DESCRIPTION OF THE PREFERRED EMBODIMENT

Figure 1:
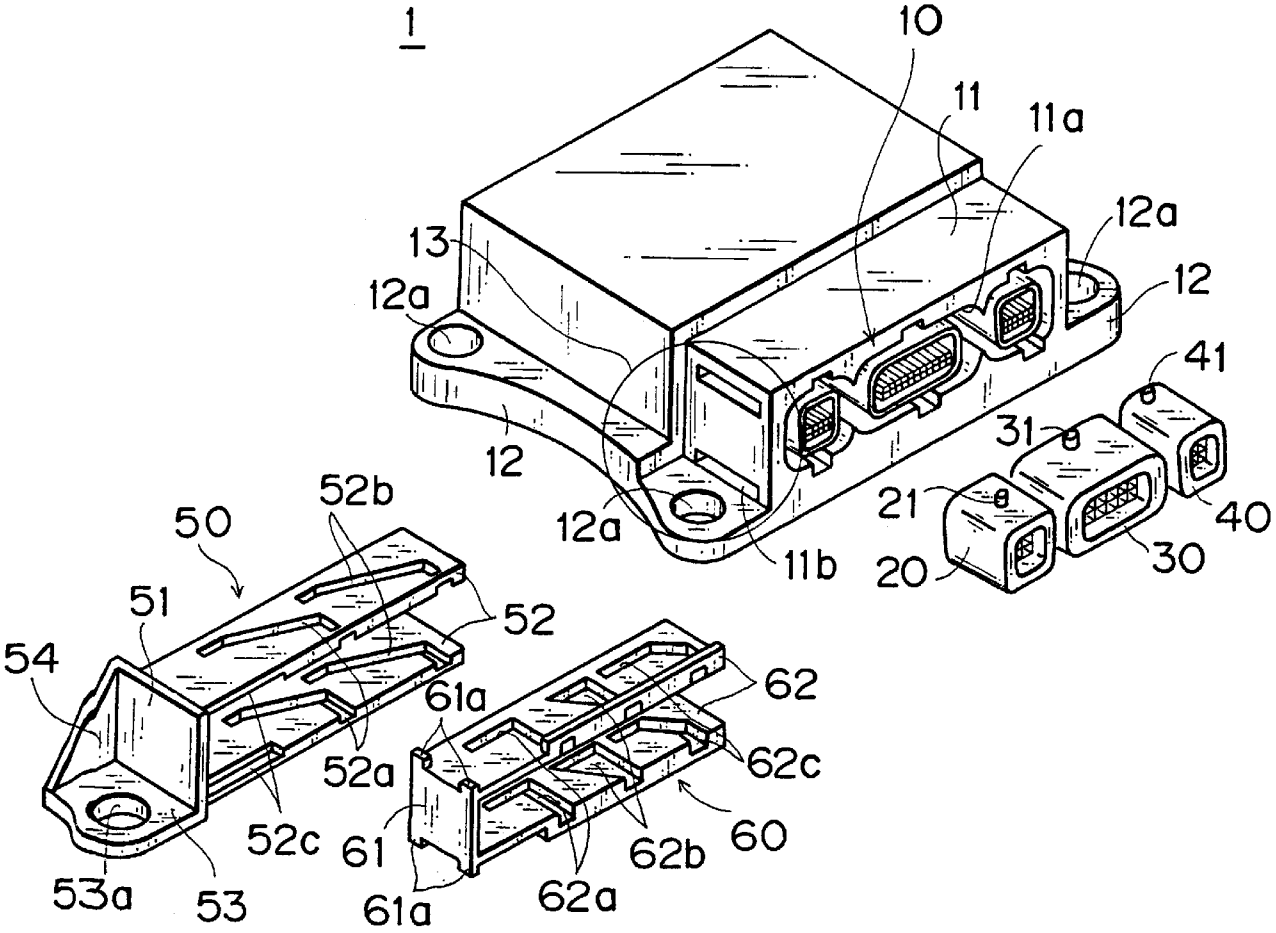
FIG. 1 is an exploded perspective view of a smaller mating force connector assembly of an embodiment according to the present invention.

Referring to the drawings, a smaller mating force connector assembly of an embodiment of the present invention will be discussed hereinafter.

In FIG. 1, a smaller mating force connector assembly 1 of this embodiment has a receptacle connector (a first connector) 10 which can be utilized, for example, in an electronic control unit, three plug connectors (second connectors) 20, 30, 40, a first sliding frame 50, and a second sliding frame 60. These components each are formed in a single-piece of a synthetic resin.

The receptacle connector 10 has a housing 11 which is defined in a body with a case of the unit. The housing 11 is formed with a receiving space 11*a* opened at the front surface thereof for the three plug connectors 20, 30, 40. The housing 11 has also two insertion openings 11*b* for the first and second sliding frame 50, 60 at a side wall of thereof.

Furthermore, on each side wall of the housing 11, there is integrally formed a bracket 12 for bolting the connector assembly 1. Each bracket 12 is provided with a pair of through holes 12*a* respectively positioned near a corner of the housing 11 for inserting a securing bolt (not shown).

In addition, an encircled part of the FIG. 1 shows a cut-out portion 13 defined by both the side wall having the openings 11*b* and a downwardly stepped portion of the bracket 12 extending from the side wall. The cut-out portion has a shape to fit with the front plate 51 of the first sliding frame 50 and the bracket 53.

The plug connectors 20, 30, 40 each have a pair of upper and lower bosses 21, 31, 41 respectively extending from the top or bottom wall thereof.

These bosses 21, 31, 41 each move one of the plug connectors 20, 30, 40 with a driving force caused by the movement of the first and second sliding frames 50, 60. The bosses 21, 31, 41 each move along one of the cam grooves 52*a*, 52*b* of the first sliding frame 50 or along the cam grooves 62*c* of the second sliding frame 60 to draw the plug connectors 20, 30, 40 into the receiving space 11*a* of the receptacle connector 10.

The first and second sliding frames 50, 60 which can slide over one another compose a duplex telescoping sliding structure. The first sliding frame 50 moves the pug connectors 20, 30, while the second sliding frame 60 moves the plug connectors 40.

The first sliding frame 50 has a pair of opposed upper and lower side plates 52 each joined to an upper or lower portion of the front plate 51. On a lower portion of the face of the plate 51, the aforementioned bolting bracket 53 extends forward.

The bracket 53 has a through hole 53*a* for a securing bolt. A rib 54 is disposed to join together the bracket 53 and the front plate 51 so as to compensate both of them.

Each side plate 52 of the first sliding frame 50 is formed with the cam grooves 52*a*, 52*b* which are associated respectively with the boss 21 of the plug connector 20 or the boss 31 of the plug connector 30. Each side plate 52 has a pair of inner sliding grooves 52*c* disposed near each side edge thereof, which will be discussed later in detail together with the second sliding frame 60.

The second sliding frame 60 has a front plate 61 and a pair of opposed upper and lower side plate 62 each joined to an upper or lower portion of the front plate 61. The second sliding frame 60 is slidably inserted between the side plates 52 of the first sliding frame 50.

The front plate 61 of the second sliding frame 60 has four stopper lugs 61*a* each disposed in each corner thereof. Each stopper lug 61*a* is slidably received in one of the sliding grooves 52*c* of the first sliding frame 50. Thereby, the second sliding frame 60 which has been inserted to be coupled with the first sliding frame 50 can slide longitudinally within the length of the sliding groove 52*c*.

Each side plate 62 of the second sliding frame 60 is formed with a non-interfering portion 62*a* overlapping the cam groove 52*a* of the first sliding frame 50, a non-interfering portion 62*b* overlapping the cam groove 52*b* of the first sliding frame 50, and the cam groove 62*c* associated with the boss 41 of the plug connector 40.

Each non-interfering portion 62*a* or 62*b* is formed so as to overlap the cam grooves 52*a*, 52*b* of the first sliding frame 50 such that the bosses 21, 31 of the plug connectors 20, 30 which move along the cam grooves 52*a*, 52*b* do not interfere with the second sliding frame 60.

Next, referring to FIGS. 1, 2A, 2B, connector mating operation of the small mating force connector assembly 1 of the aforementioned embodiment will be discussed.

At first, in FIG. 1, the second sliding frame 60 is overlapped on the first sliding frame 50, and the second sliding frame 60 is drawn out of the first sliding frame 50 to provide the longest condition of the duplex sliding frames 50, 60. Then, the side plates 52, 62 of the first and second sliding frames 50, 60 are inserted into the openings 11*b* formed in the housing 11 of the receptacle connector 10.

Figure 2A:
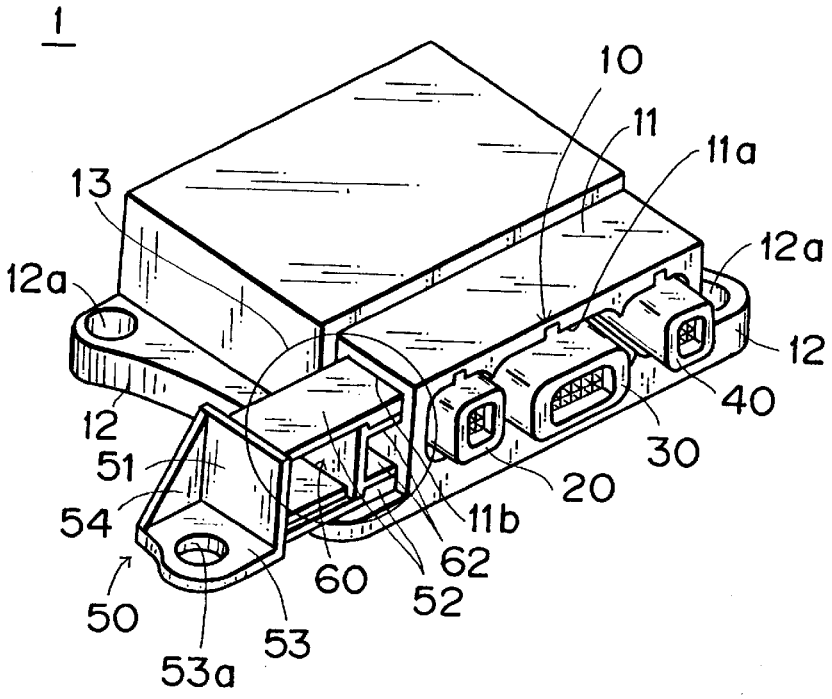
FIGS. 2A and 2B each are a perspective view showing a mating step of the smaller mating force connector assembly.
Figure 2B:
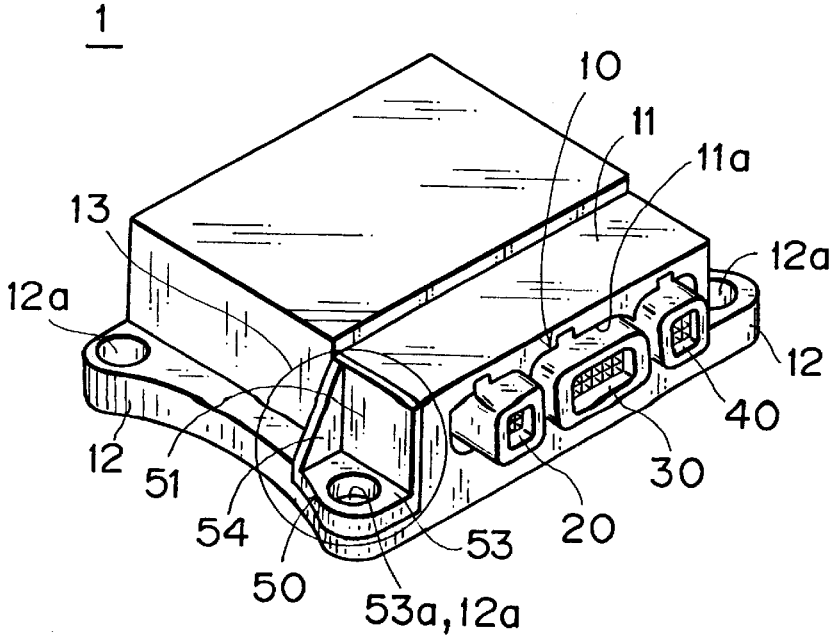
Figure 3A:
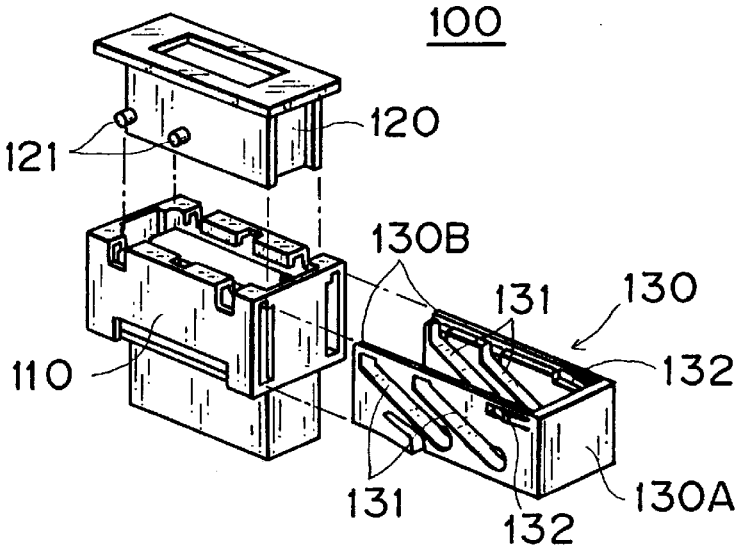
FIG. 3A PRIOR ART
FIG. 3A is an exploded perspective view of a conventional smaller mating force connector assembly, and FIGS. 3B, 3C each are a perspective view showing a mating step of the conventional connector assembly.
Figure 3B:
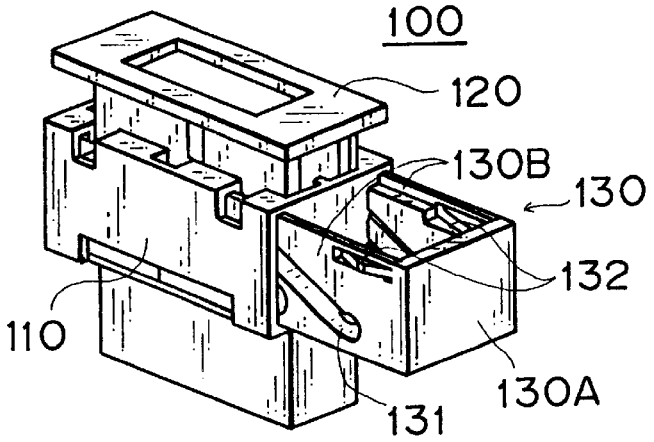
FIG. 3B PRIOR ART
Figure 3C:
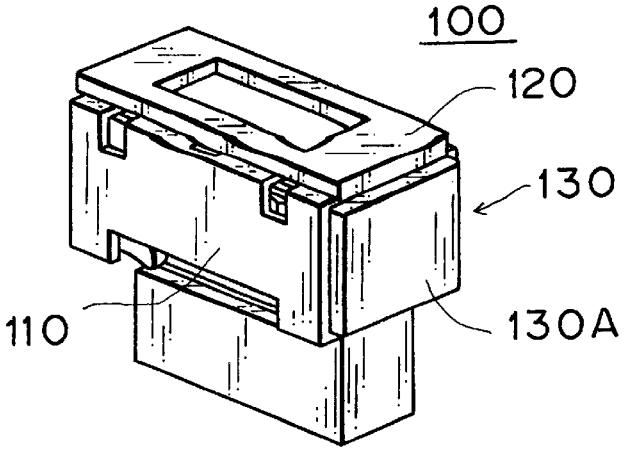
FIG. 3C PRIOR ART

Thereafter, as shown in FIG. 2A, the space 11*a* of the receptacle connector 10 receives the plug connector 20, 30, 40 such that each boss 21, 31, 41 of the plug connectors 20, 30, 40 aligns respectively with an entrance of the cam grooves 52*a*, 52*b* of the first sliding frame 50 or the entrance of cam groove 62*c* of the second sliding frame 60 (also see FIG. 1).

Then, the first sliding frame 50 is further moved into the housing 11 of the receptacle connector 10 by pushing the bracket 53 of the first sliding frame 50. The bracket 53 may be well held by the fingers. Thereby, only the first sliding frame 50 moves the bosses 21, 31 along the cam grooves 52*a*, 52*b* (see FIG. 1), which draws the plug connectors 20, 30 into the receiving space 11*a*.

Then, when the front plate 51 of the first sliding frame 50 abuts against the front plate 61 of the second sliding frame 60, the second sliding frame 60 begins to move. This movement of the second sliding frame 60 causes the boss 41 to move along the cam groove 62*c* (see FIG. 1), thereby drawing the plug connector 40 into the receiving space 11*a* with a time delay relative to the plug connectors 20, 30.

Thereafter, as shown in FIG. 2A, the first and second sliding frames 50, 60 are fully inserted into the housing 11, which completely advances the plug connectors 20, 30, 40 into the receiving space 11*a*.

In addition, when the first and second sliding frames 50, 60 are fully inserted into the housing 11, both the front plate 51 and the bracket 53 of the first sliding frame 50 contact and fit with the cut-out portion 13 of the housing 11. At the same time, the through holes 12*a*, 53*a* of the brackets 12, 53 align with one another.

Finally, the bolt is set to pass through the through holes 12*a*, 53*a* for securing the connector assembly, for example, within a vehicle body. The first and second sliding frames 50, 60 keep their fully inserted state by means of the bolting.

The small mating force connector assembly 1 of the embodiment has the following advantages.

First, since the first sliding frame 50 which has been completely inserted in the housing 11 of the receptacle connector 10 is fixed by the set bolt, the first and second sliding frames 50, 60 are secured in the connector assembly 1. Thereby, even when the connector assembly 1 is applied in a vehicle, the first sliding frame 50 (together with the second sliding frame 60) is prevented from coming of the receptacle connector 10 against an impactive force or vibration generated in the vehicle in operation.

In the mean time, when the housing 11 of the receptacle connector 10 has incompletely received the first sliding frame 50, that is, when the plug connectors 20, 30, 40 have incompletely mated with the receptacle connector 10, the couple of through holes 12*a*, 53*a* of the brackets 12, 53 do not align with one another so that the set bolt can not pass through the bracket holes 12*a*, 53*a*. Thereby, the incomplete insertion of the plug connectors 20, 30, 40 will be surely recognized.

Furthermore, since on the complete insertion of the first sliding frame 50 into the housing 11 of the receptacle connector 10, the front plate 51 and the bracket 53 of the first sliding frame 50 are received to be fit in the cut-out recess 13 of the housing 11, the complete insertion of the plug connectors 20, 30, 40 will be surely recognized.

Moreover, the front plate 51 and the bracket 53 of the first sliding frame 50 are received to fit with the cut-out recess 13 of the housing 11 of the receptacle connector 10, the appearance of the connector assembly 1 in the fully mated condition is not degraded.

In addition, a worker can hold the bracket 53 by the fingers during the insertion of the first sliding frame 50 into the receptacle connector 10, improving the insertion work of the first sliding frame 50 in workability.

The provision of the rib 54 for compensating the front plate 51 and the bracket 53 of the first sliding frame 50 increases the first sliding frame 50 in stiffness, enhancing the smooth mating of the receptacle connector 10 and the plug connectors 20, 30, 40.

The embodiment has not been discussed for limiting the present invention. The embodiment has the single receptacle connector 10 and the three plug connectors 20, 30, 40 which are coupled with the receptacle connector 10 with a time delay by using of the two sliding frames 50, 60. However, the present invention may be also applied to a small mating force connector assembly having a single receptacle connector and a single plug connector which are coupled with one another by way of a single sliding frame.

In another embodiment of the present invention, a small mating force connector assembly may have a plug connector with a front hood for receiving an opposing receptacle connector. The plug connector has a sliding frame inserted therein for drawing the receptacle connector into the hood.

What is claimed is:

1. A smaller mating force connector assembly comprising:

a first connector having a housing and a sliding frame formed with a cam groove, and a second connector having a boss movable along and within said cam groove, said sliding frame being inserted into the first connector housing so that the first connector mates with the second connector, wherein the housing of the first connector has a first bracket and the sliding frame has a second bracket, each bracket having a through hole for receiving a securing bolt, said brackets overlapping one another such that said through holes align with each other when said first connector housing receives completely said sliding frame.

2. The connector assembly set forth in claim 1, wherein the first bracket of the first connector is formed with a recess which fits in the second bracket of said sliding frame when said first connector housing receives completely said sliding frame.

3. The connector assembly set forth in claim 1, wherein said sliding frame has a pair of side plates each formed with said cam groove and a front plate which connects to each of the side plates by means of a compensating rib and the second bracket of said sliding frame is extending perpendicular to said front plate.

4. The connector assembly set forth in claim 1, wherein the through hole formed in the first bracket is used for receiving the securing bolt which also fixes the connector assembly to be mounted on a unit.

5. A smaller mating force connector assembly comprising:

a first connector having a housing and first and second sliding frames each formed with a cam groove, and a plurality of second connectors each having a boss movable along and within one of said cam grooves, said first sliding frame moving said second sliding frame when said first sliding frame is inserted into the first connector housing to mate the first connector with the second connectors, said first sliding frame moving at least one of the second connectors, said second sliding frame moving the other of the second connectors with a time lag with said at least one of the second connectors, wherein the housing of the first connector has a first bracket and the sliding frame has a second bracket, each bracket having a through hole for receiving a securing bolt, said brackets overlapping one another so that said through holes align with each other when said first connector housing receives completely said sliding frame.

* * * * *